United States Patent [19]

Steichen

[11] 4,213,648

[45] Jul. 22, 1980

[54] OXYGEN TANK HOLDING DEVICE FOR WHEELCHAIRS

[76] Inventor: Clemons P. Steichen, 1349 Prosperity Ave., Saint Paul, Minn. 55106

[21] Appl. No.: 934,399

[22] Filed: Aug. 17, 1978

[51] Int. Cl.[2] ..... A47C 7/62

[52] U.S. Cl. ..... 297/188; 297/DIG. 4; 280/645

[58] Field of Search ..... 297/188, DIG. 4, 429, 297/194; 280/242 WC, 41 A; 248/311.1

[56] References Cited

U.S. PATENT DOCUMENTS

| | | | |
|---|---|---|---|
| 2,592,449 | 4/1952 | Miller | 297/DIG. 4 |
| 3,116,046 | 12/1963 | Risdon | 248/188 X |
| 3,170,665 | 2/1965 | Ryan | 248/311.1 |
| 3,205,007 | 9/1965 | Sommer | 297/429 |
| 3,338,628 | 8/1967 | Evans | 248/188 |
| 3,704,025 | 11/1972 | Cerveny | 280/41 A |
| 3,759,569 | 9/1973 | Bennet | 297/194 |
| 3,970,344 | 7/1976 | Baumann | 297/DIG. 4 |
| 4,045,044 | 8/1977 | Bierer | 297/DIG. 4 |
| 4,063,701 | 12/1977 | Wray | 297/188 X |

*Primary Examiner*—Roy D. Frazier
*Assistant Examiner*—Peter A. Aschenbrenner
*Attorney, Agent, or Firm*—Merchant, Gould, Smith, Edell, Welter & Schmidt

[57] ABSTRACT

A wheelchair comprising a support frame of two oppositely disposed sides includes a holding device for supporting an oxygen tank thereon. The holding device includes a hollow cylinder having an open top end and a bottom end closed by a movable disk. The cylinder includes a mounting bracket for releasably attaching the cylinder to the spaced upwardly extending pins on the wheelchair frame which conventionally is used to mount detachable foot rests. The cylinder can be reversed from one side of the wheelchair to the other by inverting the cylinder.

11 Claims, 8 Drawing Figures

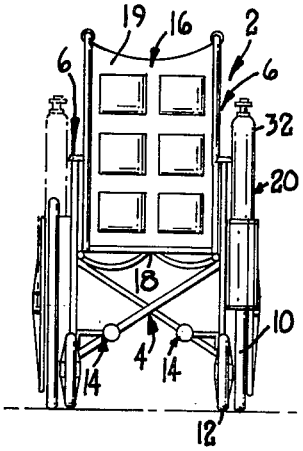
FIG. 1
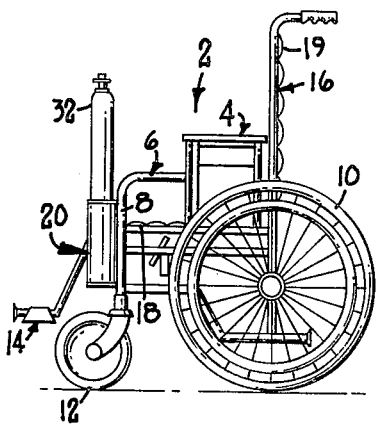
FIG. 2
FIG. 3
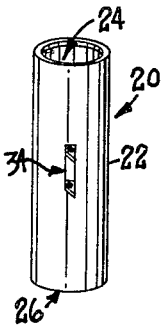
FIG. 4
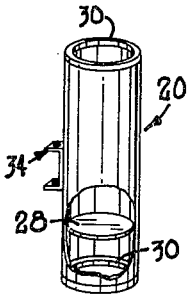
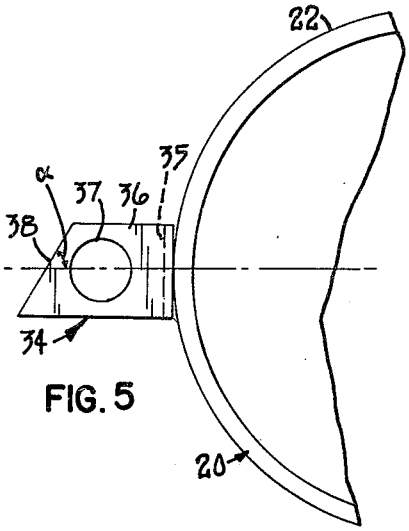
FIG. 5
FIG. 6
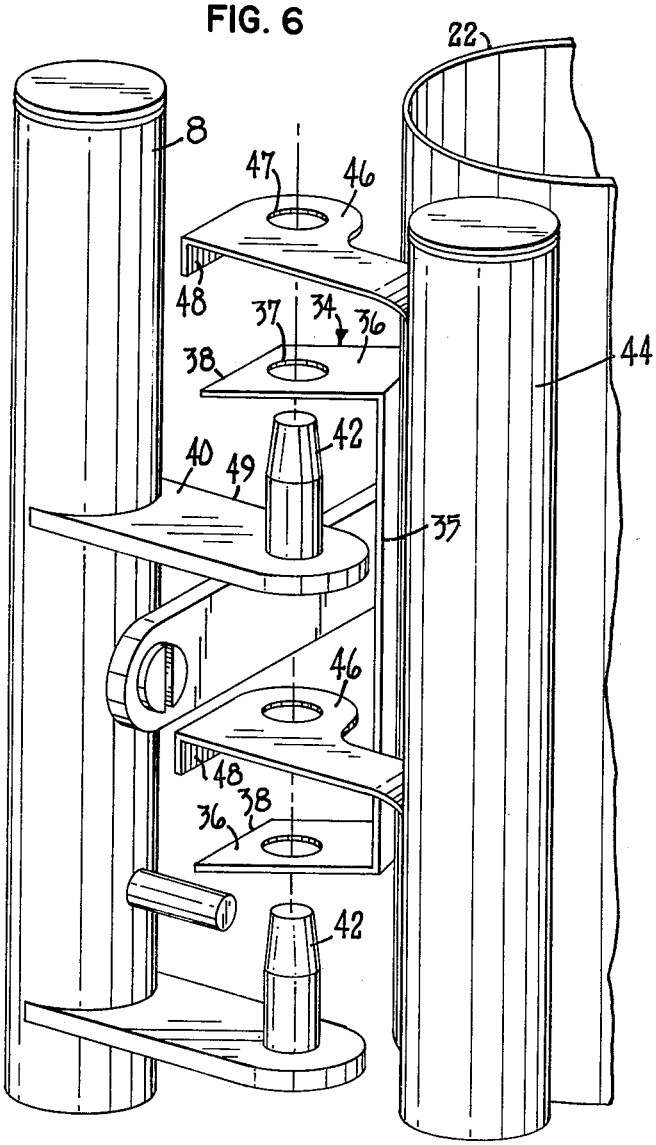
FIG. 7
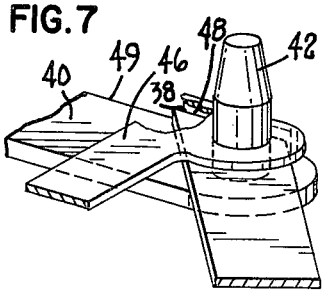
FIG. 8
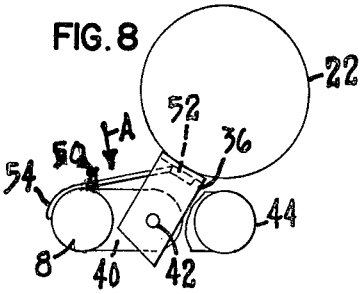

OXYGEN TANK HOLDING DEVICE FOR WHEELCHAIRS

BACKGROUND OF THE INVENTION

1. Field of the Invention

This invention relates to wheelchairs and other similar patient transporting devices. More particularly, this invention relates to wheelchairs for transporting patients who require a source of oxygen.

2. Description of the Prior Art

Many patients are confined to wheelchairs. A large number of such patients often have various types of diseases or anatomical conditions which require that oxygen be constantly available to the patient. It has been difficult for patients in this category to travel outside the home or hospital where oxygen can conveniently be made available. The difficulty associated with such travel primarily involves the difficulty of transporting a sufficient supply of oxygen. On the one hand, if the patient carries or transports a relatively small oxygen bottle which is not heavy and can be easily handled, the supply of oxygen in such a container is usually not sufficient for any extended travel. On the other hand, it is difficult and burdensome to carry a large enough oxygen tank to give the patient the desired length of time outside the home.

Various wheelchairs have from time to time included support members in which oxygen tanks or canisters can be carried. However, the support members of the prior art have a number of disadvantages. Some of these support members have comprised circular metal baskets or the like which have been fixedly attached to the wheelchair frame by welding. Such a "fixed" type of support member is not suited to be easily attached to presently existing wheelchairs by the average user thereof. Most patients do not have the necessary equipment to weld or otherwise attach such a support member to their wheelchair. In addition, most modern wheelchairs have large wheels which include a braking mechanism having a manually actuable lever. Together these components occupy most of the side area of the wheelchair. Thus, it has often been necessary that the oxygen tank support members be positioned in back of the wheelchair seat in the back portion of the frame. Such a location is not suitable for many patients because the controls on the oxygen tank for regulating the flow of oxygen will be located behind the patient's head. It thus becomes difficult for the patient to adjust these controls because of the inconveniently positioned oxygen tank.

U.S. Pat. No. 3,970,344 to Bauman discloses an oxygen tank holder for a wheelchair which is detachable. In this regard, the Bauman holder can be used on some existing wheelchairs without needing any special tools for installation. However, the structure of the Bauman holder is very complicated. It includes two depending struts which slide onto two tubular portions of the wheelchair. The struts are joined at their upper ends to a circular strap. The circular strap supports a U-shaped basket which actually contains the oxygen tank. In addition, a reinforcing ring runs around a midpoint portion of the basket and is suitably tightened or secured thereon by means of flexible cables. Furthermore, Bauman discloses locating his oxygen tank holder in back of the seat of the wheelchair. Thus, the holder of Bauman is inconveniently located and consequently disadvantageous for the reasons noted earlier. Furthermore, the complexity of the Bauman device makes it more difficult to manufacture and use and more expensive. This correspondingly tends to decrease the use of the Bauman holder by discouraging its purchase.

SUMMARY OF THE INVENTION

One aspect of this invention is an oxygen tank support member or holding device which is simple, inexpensive, and releasably attachable to most existing wheelchairs.

The present invention comprises an improved wheelchair wherein the improvement relates to a holding device for an oxygen tank or the like. Generally, the wheelchair or other patient supporting device comprises a frame having two oppositely disposed sides. A patient support sling or seat is disposed between the sides. A plurality of wheels support the frame for movement over the ground. In addition, each side of the frame carries a plurality of vertically extending pins which are colinear and spaced apart. These pins are normally for the purpose of mounting a detachable foot rest. The holding device of this invention comprises a cylinder having an open top end and a bottom end closed by a bottom member. A U-shaped bracket is attached to the side of the cylinder and includes two outwardly projecting locking flanges. These flanges are apertured such that the cylinder is received on the pins beneath the detachable foot rest. The cylinder can be easily attached or detached from the wheelchair simply by removing the detachable foot rest to gain access to the cylinder.

BRIEF DESCRIPTION OF THE DRAWINGS

This invention will be described hereafter in the following Detailed Description, when taken in conjunction with the following drawings, in which like reference numerals will refer to like elements throughout.

FIG. 1 is a front elevational view of a patient transporting device having the improved oxygen tank holding device of this invention installed thereon;

FIG. 2 is a side elevational view of the patient transporting device of FIG. 1;

FIG. 3 is a perspective view of an oxygen tank holding device according to this invention;

FIG. 4 is a perspective view of the oxygen tank holding device shown in FIG. 3, with a portion thereof broken away for clarity;

FIG. 5 is a top plan view of a portion of the oxygen tank holding device of this invention, particularly illustrating the mounting bracket therefor;

FIG. 6 is a perspective view of a portion of the patient transporting device shown in FIG. 1 and the oxygen tank holding device shown in FIGS. 3–5, particularly illustrating the manner in which the oxygen tank holding device is releasably attached to the patient transporting device;

FIG. 7 is a partial perspective view illustrating the engagement of the bracket means on the oxygen tank holding device with the frame of the patient transporting device; and FIG. 8 is a top plan view of an alternative embodiment of the locking means for the oxygen tank holding device of the present invention.

DETAILED DESCRIPTION

Referring first to FIGS. 1 and 2, an improved patient transporting device according to the present invention is generally illustrated as 2. Patient transporting device 2 will be described and illustrated herein as a wheelchair. Although the present invention, which relates to a support member or a holding device for an oxygen tank or canister is particularly adapted for installation on a wheelchair, its use is not limited solely to a wheelchair. Patient transporting device 2 could be a movable gurney (not shown) or similar device on which a patient is transported in a prone position from one location to another. All that would be required of this type of patient transporting device would be that it have appropriate mounting means so that the oxygen tank holding device of this invention can be easily attached thereto. The particular mounting means which is preferred will be described hereafter in conjunction with wheelchair 2.

Wheelchair 2 comprises a support frame which is generally indicated as 4. Support frame 4 includes two oppositely disposed sides or side members 6 made of various tubular members. Each side 6 of the wheelchair includes a front downwardly depending tubular support member 8. A plurality of wheels are attached to frame 4 for movably supporting wheelchair 2. These wheels include two relatively large wheels 10 located on a stub axle at the back of the wheelchair. The patient can grasp wheels 10 as he sits in wheelchair 2 to manually propel the wheelchair in a forward or backward direction. In addition, most wheelchairs 2 have a smaller front support wheel 12 located at the bottom of the support member 8.

Each side 6 of wheelchair 2 further has a detachable foot rest 14. Foot rest 14 is detachably connected to each side 6 by mounting means to be described in more detail hereafter. In addition, a patient support means extends between the sides 6 to support the patient in an upright position. Patient support means 16 comprises a horizontal sling or seat member 18 and an upright back rest 19. In all respects, wheelchair 2 as demonstrated herein is meant to be any conventional type of wheelchair having the basic components described herein. In this regard, wheelchair 2 is usually collapsible to allow easy storage or transport thereof.

The present invention relates to an oxygen tank support member or holding device generally indicated as 20. Referring to FIGS. 3 and 4, holding device 20 comprises an elongated hollow container or cylinder 22 having a top end 24 and a bottom end 26. Top end 24 is normally open. Bottom end 26 is normally closed by a bottom member 28. Bottom member 28 preferably comprises a movable or slidable disk having a diameter which closely corresponds to the inside diameter of cylinder 22. Disk 28 is free to slide or travel from one end of the cylinder 22 to the other. However, disk 28 will be retained inside cylinder 22 by a lip 30 at each end of the cylinder. Lip 30 ensures that each end of cylinder 22 has a diameter less than the diameter of disk 28. Cylinder 22 can be easily inverted with disk 28 always traveling to close what has become the bottom end 26. For example, when cylinder 22 is inverted or turned upside down, disk 28 will fall from what used to be the bottom end (and is now the top end) to what used to be the top end (and is now the bottom end), thereby ensuring that the actual bottom end 26 is always closed by disk 28.

Cylinder 22 may be made of any suitable materials. It is preferred that cylinder 22 be made of sheet metal or the like. This metal is preferably rolled or otherwise shaped into a circular form and is then welded along the joining edges to form cylinder 22. However, cylinder 22 could be extruded if so desired. Alternatively, cylinder 22 could be made of materials other than metal, such as plastic. The primary function of cylinder 22 is to support an oxygen tank 32 therein. In this regard, the diameter of cylinder 22 is sufficient to allow tank 32 to be easily inserted through the open top end 24 of cylinder 22. Bottom disk 28 support and retains oxygen tank 32 in cylinder 22.

Oxygen tank holding device 20 also includes means for detachably mounting the cylinder 22 on the frame 4 of wheelchair 2. This mounting means includes a mounting bracket generally indicated as 34. Mounting bracket 34 has a base portion 35 which is welded or otherwise fixedly attached to the side of cylinder 22. Two outwardly projecting locking flanges 36 extend from each end of base portion 35. Locking flanges 36 give a U-shaped configuration to bracket 34. Each of the flanges 36 has an aperture or bore 37 therethrough. The apertures 37 in the respective flanges 36 are generally aligned with one another in a colinear manner. The outer edge of each flange 36, which is denoted respectively as 38, is cut away with regard to a line 39 extending through the center of aperture 37 and the center of cylinder 22. The particular angle formed between edge 38 and the line 39 will be denoted as $\alpha$. Angle $\alpha$ is selected to achieve a particular result described in detail hereafter.

Referring now to FIGS. 6 and 7, each front support member 8 on wheelchair 2 conventionally has two outwardly extending surfaces or flanges 40. Each flange 40 has an upwardly extending pin 42 thereon. Detachable foot rests 14 have conventionally been releasably mounted on pins 42. In this regard, each detachable foot rest 14 includes an upwardly extending support rod 44. Rod 44 has two horizontal and outwardly extending flanges 46 spaced one above the other. Each flange 46 has an aperture 47. Apertures 47 on the flanges 46 are colinearly arranged and are adapted to be received on pins 42. In addition, the outer end of each flange 46 has a downwardly extending locking surface 48 which is disposed at right angles to flange 46. Locking surface 48 is adapted to abut against one side 49 of flange 40 to firmly lock the foot rest 14 in an appropriate position on wheelchair frame 4 as shown in FIG. 7.

Cylinder 22 is adapted to be positioned around pins 42 to detachably couple cylinder 22 to wheelchair 2 whenever it is desired to support an oxygen bottle 38 thereon. To attach cylinder 22, either one of the foot rests 14 must first be removed. This is accomplished by lifting upwardly on the foot rests until the apertures 47 disengage pins 42. With one foot rest removed, the U-shaped bracket 34 is positioned such that the apertures 37 in the locking flanges 36 are positioned above pins 42. Cylinder 22 is then moved downwardly until the pins 42 protrude through the apertures 37. In this regard, aperture 37 is sized somewhat greater than the diameter of pins 42 to allow cylinder 22 to be easily received therearound. Foot rest 14 is then reattached back onto pins 42 such that each foot rest flange 46 overlies each flange 36 as shown in FIG. 7. In this position, locking surface 48 of each flange abuts the side 49 of flange 40.

Referring now to FIGS. 5–7, cylinder 22 desirably is located to one side of foot rest 14 in such a position that cylinder 22 is located to the outside of support rod 44. This location is desirable because movement of the patient into and out of the wheelchair seat 18 is not in any way obstructed by cylinder 22. However, to achieve such an orientation for cylinder 22, the locking flanges 36 of bracket 34 will be angularly offset from the flanges 46 of foot rest 14. See FIG. 7. In conjunction with this location, the angle $\alpha$ is selected to make certain that the edge 38 of each locking flange 36 is maintained parallel to and closely spaced from the locking surface 48 of the flanges 46. With such an orientation of the edges 38, cylinder 22 will be locked or restrained from rotation relative to the wheelchair support frame 4. Cylinder 22 is effectively locked because any attempted rotation of the cylinder around pins 42 would cause the edges 38 to engage and abut against the locking surface 48. This abutment prevents any rotation of cylinder 22. Consequently, not only is cylinder 22 conveniently located to one side of the wheelchair 2, but the cylinder 22 is also locked to prevent any unneeded or undesired rotation of the cylinder during movement of the wheelchair.

Oxygen tank support cylinder 22 of the present invention is particularly advantageous for a number of reasons. For example, it is extremely simple and thus easily and inexpensively fabricated. In addition, the particular arrangement of a U-shaped mounting bracket 34 ensures that cylinder 22 can be easily and quickly attached or detached to any conventional patient transport device having a vertical series of spaced upstanding pins 42. Such an attachment can be quickly and easily made. In addition, the support cylinder 22 will be located in most conventional wheelchairs at the front of the wheelchair 2 within easy reach of the patient riding therein. Thus, the patient is quickly and easily able to adjust the oxygen controls on oxygen tank 32.

Another significant feature of the present invention is the use therein of a slidable bottom member, i.e. disk 28. When cylinder 22 is inverted, disk 28 slides from one end to the other such that it is always located in that end of the cylinder 22 which is lowermost. This allows cylinder 22 to be easily and quickly reversed from one side of the wheelchair 2 to another. For example, referring first to FIG. 1, the oxygen tank 32 and support cylinder 22 are shown in solid lines at the right of the machine. With tank 32 removed, the cylinder 22 can be removed from the pins 42 on the right side and inverted. Cylinder 22 can then quickly and easily be attached to the pins 42 on the other side of wheelchair 2 (as shown in phantom lines in FIG. 1). Oxygen tank 32 can then be reinserted in cylinder 22. Thus, the same oxygen tank support cylinder 22 can be mounted on existing wheelchairs in either a right or left hand orientation to correspond to the orientation of the patient who normally uses wheelchair 2. This flexibility is achieved even though only one support cylinder 22 need be used. When the cylinder 22 is inverted and moved from one side to another side, the angle $\alpha$ will still be sufficient to ensure the locked orientation of cylinder 22 because cylinder 22 is desirably offset to each side of wheelchair 4 by an identical degree.

Referring now to FIG. 8, an alternative form of the locking means for holding oxygen support cylinder 22 in place during operation is illustrated as comprising a spring member 50. Spring member 50 is attached at one end in any suitable manner as illustrated generally as 52. This attachment could comprise a suitable weld or the use of bolts or the like through bracket 34. Spring member 50 preferably comprises a U-shaped bail member having the opposed ends thereof attached to the bracket 34 at 52. The outer free end of spring member 50 is curved as at 54 to encircle the tubular support member 8.

In the operation of locking means 50, whenever cylinder 22 would tend to be rotated around pins 42 relative to rods 8 and 44, the engagement of spring member 50 on support member 8 resists this movement by imposing a spring force on cylinder 22 which restores the cylinder 22 to a position closely adjacent the rods 8 and 44. This restoring force is indicated by an arrow A in FIG. 8. Spring member 50 may be made of any suitable material such as spring steel or the like. Any other suitable resilient means for imposing a restoring force on cylinder 22 could also be used. The alternative locking means 50 shown in FIG. 8 could be used whenever the particular make of the wheelchair on which support cylinder 22 is mounted does not have the locking flanges 48 present on the flanges 46. Although many wheelchairs today have two opposed flanges 46 for mounting on pins 42, not all are provided with locking flanges 48. In this latter event, locking means 50 can be used.

Various modifications of this invention will be apparent to those skilled in the art. For example, two vertically spaced pins 42 have been illustrated as serving as the mounting means for the foot rest 14 and also as the mounting means for cylinder 22. However, only one pin 42 is needed if that pin has the required support and strength to hold the combined weight of cylinder 22 and oxygen tank 32. In addition, oxygen support cylinder 22 can be easily used on patient support and transporting devices other than wheelchairs as long as such devices are provided with any type of upwardly extending mounting pins. Furthermore, oxygen support cylinder 22 could be manufactured such that the disk 28 is fixedly located at one end of the cylinder to permanently close that end. In such an event, that particular configuration of the cylinder 22 could not be reversed from one side of the wheelchair to the other through a simple inversion. Thus, the scope of this invention is to be limited only by the appended claims.

What is claimed is:

1. An improved wheelchair of the type having a frame including two oppositely disposed sides; each side including a support member having means for detachably mounting a foot rest thereon; a plurality of wheels attached to the frame to allow movement of the wheelchair; and patient support means attached to the frame for supporting a patient therein; and wherein the improvement comprises:

at least one oxygen tank holding device configured to releasably support an oxygen tank therein, and wherein the holding device has means for detachably connecting the holding device to the foot rest mounting means on at least one of the support members.

2. An improved wheelchair as recited in claim 1, wherein the holding device connecting means further includes means for locking the holding device relative to the frame.

3. An improved wheelchair of the type having a frame which includes two oppositely disposed side members, each side member having a foot rest detachably connected to the front thereof by at least one upwardly extending pin on the side member which pin releasably receives an apertured flange on the foot rest, the foot rest flange having a downwardly extending locking surface which bears against a portion of the side member adjacent the pin to lock the foot rest thereon, and wherein the improvement relates to an oxygen tank support member which comprises:

(a) a hollow elongated cylinder having an open top end and a bottom end which is closed by a bottom member, the open top end being suited for receiving an oxygen tank therein which tank is supported by the bottom member; and (b) means secured to the cylinder to releasably attach to the pin on either side member of the wheelchair, the attachment means comprising a bracket having a locking flange which projects outwardly from the cylinder and which is apertured to receive the pin, the locking flange being located on the pin beneath the foot rest flange, whereby the cylinder is releasably attached to the wheelchair for receiving an oxygen tank therein.

4. An improved wheelchair as recited in claim 3, in which the locking flange on the cylinder is so configured such that the edge of the locking flange bears against the locking surface on the foot rest flange, whereby the cylinder is locked into position relative to the side of the wheelchair on which it is mounted.

5. An improved wheelchair as recited in claim 4, in which the locking flange on the cylinder is cut away at an angle relative to a line through the center of the flange aperture and cylinder such that the edge formed thereby suitably bears against the locking surface when the locking flange is received on the pin.

6. An improved wheelchair as recited in claim 4, in which the bottom member is fixedly located in the bottom end of the cylinder.

7. An improved wheelchair as recited in claim 4, in which the bottom member comprises a movable disk which can slide from one end of the cylinder to the other to allow the cylinder to be inverted and the top and bottom ends thereof reversed, each end of the cylinder having means for supporting the disk in a position in which the disk closes that end when received therein, and wherein the locking flange is so configured such that when the cylinder is inverted from one position to another the cylinder can be respectively located on one side or the other of the wheelchair on the pin thereat.

8. An improved wheelchair as recited in claim 7, in which the disk supporting means comprises an inturned lip on each end of the cylinder such that each end of the cylinder has a diameter which is less than the diameter of the disk.

9. An oxygen tank holding device for use on a patient transporting device having at least one upwardly extending support pin and a locking surface located adjacent the support pin, which comprises:

(a) a hollow, elongated cylinder having an open top end and a bottom end which is closed by a bottom member, the open top end being suited for receiving an oxygen tank therein which tank is supported by the bottom member;

(b) means secured to the cylinder to releasably attach to the support pin, the attachment means comprising a bracket having a substantially planar locking flange which projects outwardly from the cylinder to form a free edge and which is apertured to receive the pin, whereby the cylinder is releasably attached to the patient transporting device for receiving the oxygen tank therein; and (c) wherein the locking flange on the cylinder is so configured such that the free edge of the locking flange bears against the locking surface on the patient transporting device, whereby the cylinder is locked into position relative to the patient transporting device on which it is mounted.

10. An oxygen tank holding device for use on a patient transporting device having at least one upwardly extending support pin, which comprises:

(a) a hollow, elongated cylinder having an open top end and a bottom end which is closed by a bottom member, the open top end being suited for receiving an oxygen tank therein which tank is supported by the bottom member;

(b) means secured to the cylinder to releasably attach to the support pin, the attachment means comprising a bracket having a locking flange which projects outwardly from the cylinder which is apertured to receive the pin, whereby the cylinder is releasably attached to the patient transporting device for receiving the oxygen tank therein; and (c) wherein the patient transporting device has a support pin on each side thereof, and wherein the bottom member comprises a movable disk which can slide from one end of the cylinder to the other to allow the top and bottom ends of the cylinder to be reversed by inversion of the cylinder, each end of the cylinder being configured to retain the disk in an oxygen tank support position, and wherein the locking flange is so configured such that when the cylinder is inverted from one position to another the cylinder can be respectively located on one side or the other of the patient transporting device on the pins thereat.

11. An oxygen tank holding device for use on a patient transporting device having at least one upwardly extending support pin, which comprises:

(a) a hollow, elongated cylinder having an open top end and a bottom end which is closed by a bottom member, the open top end being suited for receiving an oxygen tank therein which tank is supported by the bottom member;

(b) means secured to the cylinder to releasably attach to the support pin, the attachment means comprising a bracket having a locking flange which projects outwardly from the cylinder which is apertured to receive the pin, whereby the cylinder is releasably attached to the patient transporting device for receiving the oxygen tank therein; and (c) wherein each side of the wheelchair has two colinear vertically spaced support pins, and wherein the bracket is U-shaped having two, outwardly extending locking flanges each of which is apertured to respectively be located on and received around one of the support pins.

* * * * *